United States Patent [19]

Atkins

[11] 3,996,642

[45] Dec. 14, 1976

[54] ADJUSTABLE DEGREE DOOR HOLDER

[75] Inventor: Norman C. Atkins, Franklin Park, Ill.

[73] Assignee: The Citation Companies, Grand Rapids, Mich.

[22] Filed: Feb. 13, 1976

[21] Appl. No.: 657,735

[52] U.S. Cl. ..... 16/82; 292/275

[51] Int. Cl.[2] ..... E05F 5/02

[58] Field of Search ..... 16/49, 82; 292/275, 292/262, 265–274, 276–278

[56] References Cited

UNITED STATES PATENTS

| | | | |
|---|---|---|---|
| 906,514 | 12/1908 | Dengler | 292/268 X |
| 1,573,456 | 2/1926 | Sibley | 292/275 |
| 1,605,400 | 11/1926 | Garske et al. | 292/262 |

*Primary Examiner*—Werner H. Schroeder
*Assistant Examiner*—Conrad L. Berman
*Attorney, Agent, or Firm*—McGarry & Waters

[57] ABSTRACT

An apparatus to vary the degree which a door may be opened and held in place. An operating arm of the door holder is pivotably mounted to a slide which is mounted within a slide channel. Holding means releasably hold the slide at a fixed position within the slide channel. The other end of the operating arm is pivotably mounted to an adjustable bracket. The bracket is seated within a track and is capable of adjustable movement along the track. Fastening means secure the bracket with respect to the track in a plurality of fixed positions.

8 Claims, 3 Drawing Figures

ADJUSTABLE DEGREE DOOR HOLDER

BACKGROUND OF THE INVENTION

1. Field of the Invention

This invention relates to an operable arm-type door holder that can vary the maximum degree that a door can be opened.

2. Description of the Prior Art

Door holders are known that incorporate operating arms pivotably connected to a slide which reciprocably slides within a channel. Various mechanisms and means are incorporated within the channel to releasably hold the slide channel or restrain its movement. The channel has usually been located within the top surface of the door, or flush mounted to the door jamb.

The other end of the operating arm pivotally connects to a mount. The mount can be a fastening screw or can be a closing mechanism which then attaches to a door or door frame head jamb. The pivotal connection between the mount and operating arm is in a fixed position with regard to the door or door frame head jamb.

One such device is disclosed in the D. H. Ellis U.S. Pat. No. 2,945,255 issued July 19, 1960. The Ellis reference discloses an elongated housing mortised in, or attached on a surface of a door frame head jamb. The elongated housing houses a roller which freely rolls within the housing until engaging a stop member and which is pivotabley connected to one end of the operating arm. The stop member is adjustable along a guide rail. The other end of the operating arm can be attached to a surface mounted or mortised closer mechanism.

SUMMARY OF THE INVENTION

In accordance with the present invention, a door holder varying the degree in which a door can be opened comprises a slide bar pivotably connected to an operable arm. The slide bar is seated within a channel. The other end of the operable arm is pivotably connected to a bracket which is seated within a track. The bracket can be locked into a fixed position with respect to the track.

The track is preferably mortised in the top surface of the door or to the door frame head jamb. The channel is attached to the other of the door and the door frame head jamb. Preferably, the channel is mortised in the other of the top surface of the door and the door frame head jamb. The operable arm extends between the channel and track. Preferably, and for purposes of discussion, the track is attached to the door frame head jamb and the channel is attached to the door.

Preferably, the track has an open bottom side and has lips located at the bottom extending inwardly from the sides of the track. The bracket rests upon the lips to secure the bracket within the track. Preferably, the bracket has a ridge portion which rests upon the lips.

The bracket is secured in a fixed position by fastening means which preferably include a bar placed between the bracket and a top part of the track. A plurality of threaded fasteners engage threaded apertures through the bracket. The threaded fasteners bear against the bar and wedge the bar and bracket within the track. The threaded fasteners can be positioned in a release position which releases the bracket and bar from their fixed position to enable readjustment in a new position.

Preferably, the bar has indentations into which the threaded fasteners extend and maintain alignment between the bar and the bracket when the bracket is moved horizontally.

DETAILED DESCRIPTION OF THE PREFERRED EMBODIMENT

Figure 1:
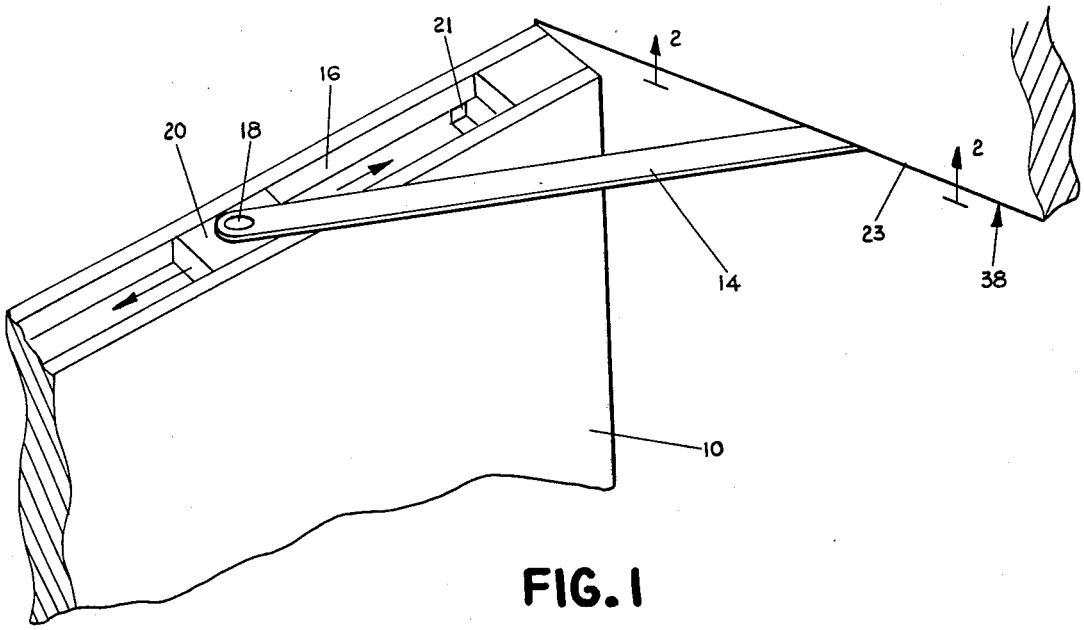
FIG. 1 is a perspective view of a slide bar door holding showing a conventional guide channel door holding.

Referring now to the drawings, FIG. 1 shows an operable arm 14 having one end 18 pivotably connected to a slide bar 20. The slide bar 20 is seated in a channel 16 and capable of sliding horizontally along the channel. The channel 16 is mortised within the top surface of a door 10. Within the channel lies a pressure pin 21 which is capable of engaging and securing the slide bar 20 against small force or pressure when the slide bar 20 passes over the pin 21. A larger amount of force or pressure exerted between the slide bar 20 and pressure pin 21 will release the pressure pin from the slide bar. A force in the form of a person pushing or pulling the door 10 is sufficient to release the slide bar 20 from the pin 21.

Figure 2:
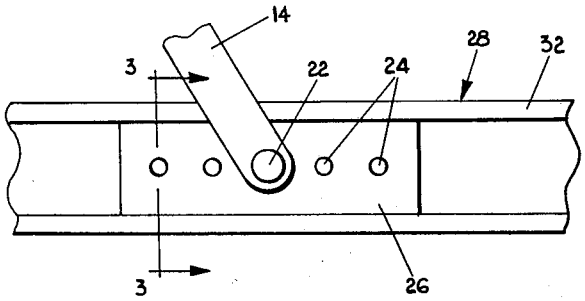
FIG. 2 is a bottom plan view of the invention seen along lines 2—2 of FIG. 1.
Figure 3:
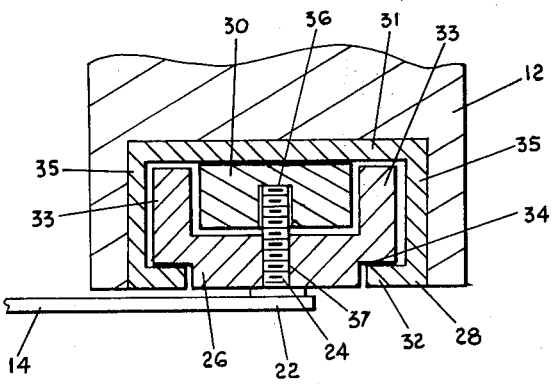
FIG. 3 is a cross-sectional view taken along lines 3—3 of FIG. 2.

As shown in FIG. 2, an end 22 of the operable arm 14 is pivotably mounted onto a bracket 26. The bracket is seated within a track 28 which is mortised under a door frame head jamb 23 shown in FIG. 1. At the bottom of the track, lips 32 extend inwardly and hold the bracket 26 within the track 28. As shown in FIG. 3, the lips preferably abut a ridged portion 34 of the bracket 26. The bracket 26 has four threaded apertures 37 which engage threaded fasteners 24.

The bracket has two upright sides 33 which lie adjacent to side sections 35 of the track 28 and extend upwardly to top section 31 of the track 28. A bar 30 lies between the two upright sections 33. The bar 30 has four indentations 36 which receive the threaded fasteners 24. When the threaded fastener 24 is threaded into the bracket, it bears against the indentations 36 of the bar 30, raising the bar until the bar 30 abuts the top surface 31 of the track 28. Further tightening of the fastener 24 causes the bar and bracket to be wedged fixedly within the track 28. The four threaded fasteners 24 can be loosened, which releases the bracket 26 and bar 30 from the fixed position, and enables the bracket 26 and bar 30 to slide horizontally along the track to any other desired position where the fasteners 24 can be retightened and the bracket 26 fixed into a new position along the track 28.

The indentations 36 in the bar 30 enables the bar to be moved with the bracket when the fasteners 24 are loosened. When the bracket is moved horizontally, the threaded fastener 24 also moves. In turn, the threaded fasteners 24, being received in the indentation, bear against indented surface 36 and move the bar 30. The bar 30 is automatically aigned in its correct position with regard to the bracket 26 by the aignment of the fasteners 24 in the indentations 36.

When the door is in a closed position, the operable arm 14 lies along the plane of the door 10 and door frame 38 so that the arm is concealed from view when the door 10 is closed. The operable arm 14 pivots around end 22 outwardly from the door frame plane as the door is opened. The end 18 pivotably attached to the slide bar 20 exerts force on the slide bar 20 to slide toward the pressure pin 21.

As the bracket is fixed farther away from the hinges (not shown of the door 10, the slide bar 20 engages the pressure pin 21 when the door is opened a smaller degree. Conversely, as the bracket is positioned closer toward the hinge, the door may be opened a greater degree before the slide bar 20 engages the pressure pin 21. Each position of the bracket 26 varies the degree in which the door 10 may be opened. Thus, the invention provides a system by which the degree to which the door is opened can be adjusted to suit the job.

It should be understood that the foregoing embodiment of the present invention is merely illustrative of the preferred practice of the invention and that changes and modifications may be made in the arrangements and details of construction of the embodiment described herein without departing from the spirit and scope of the invention.

The embodiments of the invention in which an exclusive property or privilege is claimed are defined as follows:

1. In an adjustable degree door holder having an operating arm with an end pivotably connected to a slide in a channel which is mounted to one of a door and a frame, means for releasably holding the slide stationary at a certain position in the channel, the improvement comprising:

a track for mounting on the other of the door and frame;

a bracket pivotably mounted to another end of the operating arm, the bracket being slidably seated in the track; and fastening means for adjustably securing the bracket in a fixed position with respect to the track.

2. An apparatus as described in claim 1 wherein the operable arm lies between and is coplanar with the door and the door frame when the door is in a closed position.

3. An apparatus as described in claim 1 wherein the channel is disposed on the top surface of the door and the track is disposed in a top section of a door frame, the track has an open bottom side exposed downwardly from the door frame.

4. An apparatus as described in claim 3 wherein the track lies in a recessed position within the top section of the door frame.

5. An apparatus as described in claim 3 wherein the track has a lip portion, the lip portion has a top surface which abuts the bracket and supports the bracket in the track.

6. An apparatus as described in claim 5 wherein the bracket has a ridge portion which sets upon the top surface of the lip portion so as to support the bracket within the track.

7. An apparatus as described in claim 5 wherein the fastening means comprises a bar disposed between the bracket and the top section of the track; at least one threaded fastener engages a corresponding threaded aperture in the bracket, bears against the bar, and wedges the bar and bracket within the track in a plurality of fixed positions within the track.

8. An apparatus as described in claim 7 wherein the bar has indentations which receive each threaded fastener, and each threaded fastener, when in a release position, extends into the indentations and maintains alignment between the bracket and the bar.

* * * * *